US007601042B2

(12) United States Patent
Srinivasan-Rao et al.

(10) Patent No.: US 7,601,042 B2
(45) Date of Patent: Oct. 13, 2009

(54) SECONDARY EMISSION ELECTRON GUN USING EXTERNAL PRIMARIES

(75) Inventors: Triveni Srinivasan-Rao, Shoreham, NY (US); Ilan Ben-Zvi, Setauket, NY (US)

(73) Assignee: Brookhaven Science Associates, LLC, Upton, NY (US)

( * ) Notice: Subject to any disclaimer, the term of this patent is extended or adjusted under 35 U.S.C. 154(b) by 355 days.

(21) Appl. No.: 11/734,400

(22) Filed: Apr. 12, 2007

(65) Prior Publication Data

US 2007/0181833 A1 Aug. 9, 2007

Related U.S. Application Data

(62) Division of application No. 10/917,309, filed on Aug. 13, 2004, now Pat. No. 7,227,297.

(51) Int. Cl.
*H01J 43/04* (2006.01)

(52) U.S. Cl. ..... 445/23; 313/523; 250/214 VT

(58) Field of Classification Search ..... 313/523–544, 313/103 R, 104 R, 105 R, 103 CM; 250/214 VT, 250/234, 216; 445/23–25
See application file for complete search history.

(56) References Cited

U.S. PATENT DOCUMENTS 6,116,976 A 9/2000 Sinor et al.
6,633,129 B2 10/2003 Mako
6,642,657 B2 11/2003 Mako et al.
6,674,235 B2 1/2004 Lim et al.

OTHER PUBLICATIONS

Joan E. Yater, "Investigation of Wide Bandgap Materials for Cold Electron Emission," Workshop on Cathodes for Relativistic Electron Beams, Naval Research Laboratory (presented on May 10-11, 2001), web posting Jun. 14, 2001.
I.L. Krainsky, et al., "Secondary Electron Emission from Chemical Vapor Deposited Diamond Films with Negative Electron Affinity," *Applied Surface Science* 111, pp. 265-269 (1997).
I.L. Krainsky, et al., "Negative-Electron-Affinity Effect on the Surface of Chemical-Vapor-Deposited Diamond Polycrystalline Films," *Physical Review B*, vol. 53, No. 12, pp. R7650-R7653 (Mar. 15, 1996-II).

(Continued)

*Primary Examiner*—Joseph L Williams
(74) *Attorney, Agent, or Firm*—Dorene M. Price

(57) ABSTRACT

An electron gun for generating an electron beam is provided, which includes a secondary emitter. The secondary emitter includes a non-contaminating negative-electron-affinity (NEA) material and emitting surface. The gun includes an accelerating region which accelerates the secondaries from the emitting surface. The secondaries are emitted in response to a primary beam generated external to the accelerating region. The accelerating region may include a superconducting radio frequency (RF) cavity, and the gun may be operated in a continuous wave (CW) mode. The secondary emitter includes hydrogenated diamond. A uniform electrically conductive layer is superposed on the emitter to replenish the extracted current, preventing charging of the emitter. An encapsulated secondary emission enhanced cathode device, useful in a superconducting RF cavity, includes a housing for maintaining vacuum, a cathode, e.g., a photocathode, and the non-contaminating NEA secondary emitter with the uniform electrically conductive layer superposed thereon.

7 Claims, 6 Drawing Sheets

OTHER PUBLICATIONS

A. Hoffmann, et al., "Decay of Secondary Electron Emission and Charging of Hydrogenated and Hydrogen-Free Diamond Film Surfaces Induced by Low Energy Electrons," *J. Appl. Phys*., vol. 91, No. 7, pp. 4726-4732 (Apr. 1, 2002).

A. Shih, et al., "Secondary Electron Emission from Diamond Surfaces," *J. Appl. Phys*., vol. 82, No. 4, pp. 1860-1867 (Aug. 15, 1997).

J.E. Yater, et al., "Electron Transport and Emission Properties of C(100)," *Physical Review B*, vol. 56, No. 8, pp. R4410-R4413 (Aug. 15, 1997).

J.E. Yater, et al., "Transmission of Low-Energy Electrons in Boron-Doped Nanocrystalline Diamond Films," *J. Appl. Phys*., vol. 93, No. 5, pp. 3082-3089 (Mar. 1, 2003).

RF Cavity
Cathode Insert
Laser
Secondary Electrons
Ultra High Vacuum
Photo-Cathode
Primary Electrons
Diamond Window
Diamond
Hydrogen termination
Gold layer
14
16
18
19
36
38
46
70
72
74
82
84
86
88
90
92
94
106

SECONDARY EMISSION ELECTRON GUN USING EXTERNAL PRIMARIES

This is a divisional of copending application Ser. No. 10/917,309 filed Aug. 13, 2004.

This invention was made with Government support under contract number DE-AC02-98CH10886, awarded by the U.S. Department of Energy. The Government has certain rights in the invention.

FIELD OF THE INVENTION

The present invention relates generally to electron guns and more particularly to a reliable and efficient long-life electron gun, with efficient, long-life, non-contaminating cathodes, for the generation of high-current high-brightness electron beams.

BACKGROUND OF THE INVENTION

Electron guns are used to generate a directed stream of electrons with a predetermined kinetic energy. Electron guns are most commonly used to generate electron beams for vacuum tube applications such as cathode ray tubes (CRTs) found in televisions, game monitors, computer monitors and other types of displays.

Many medical and scientific applications require the generation of electron beams as well. Electron guns provide the electron source for the generation of X-rays for both medical and scientific research applications, provide the electron beam for imaging in scanning electron microscopes, and are used for microwave generation, e.g., in klystrons. Commonly, the electron gun is incorporated into a linear accelerator system, or LINAC. LINACs have many industrial applications, including radiation therapy, medical and food product sterilization by irradiation, polymer cross linking and nondestructive testing (NDT) and inspection.

In addition, an electron gun is a key component of the injector system of any high-energy particle accelerator system. The creation of high average-current, high brightness electron beams is a key enabling technology for these accelerator-based systems, which include high-energy LINACs such as Energy-Recovery LINAC (ERL) light sources, electron cooling of hadron accelerators, high-energy ion colliders, and high-power free-electron lasers (FELs). For these applications, the electron gun generates and provides a charged particle beam for input to the accelerator. The output of the accelerator system is an accelerated beam at the energy required for the particular application.

For a growing number of high-power accelerator-based systems, the development of a high average-current high-brightness electron beam has become a major challenge. The electron gun of the injector system must also be capable of delivering short-duration pulses of electrons, i.e. short bunch lengths, at a high repetition rate, preferably in a continuous-wave (CW) mode. These requirements have not been realized by conventional electron gun designs, which suffer from unacceptable degradation in efficiency, reliability and lifetime.

An electron gun, also referred to as an injector, is composed of at least two basic elements: an emission source and an accelerating region. The emission source includes a cathode, from which the electrons generated in the emission source escape. The accelerating region accelerates the electrons in the presence of an electric field to an accelerating electrode (anode), typically having an annular shape, through which the electrons pass with a specific kinetic energy. Typical injectors deliver all of the electrical current from a single cathode, which is incorporated into the accelerating region. The commonly known cathodes used in electron guns generate electrons either by thermionic emission, field emission, or photoemission.

Thermionic emission cathodes emit thermally-generated electrons. These cathodes are typically used in applications with low power requirements, for example, as the electron beam source in electron microscopes. Capable of reaching current densities of only about 20 Amps/cm$^2$ and unable to provide short pulses, these cathodes are inappropriate for use in high-current electron guns for high-power accelerator-based systems. In addition, thermionic emitters are easily contaminated.

The field emission cathodes currently known are likewise inadequate, because they can not deliver high-brightness, or equivalently, low-emittance electron beams in an efficient manner. The high field strengths (at least 1 MV/m) required to obtain reasonable emission make these cathodes impractical for reliable and efficient use in accelerator applications.

Photoemission cathodes have been used in electron guns, commonly referred to as photoinjectors, with some success for accelerator-based systems. Photoinjectors are known to produce a higher quality beam than most other types of electron guns. These electron guns typically generate a large number of electrons by photoemission from a laser-illuminated photocathode located inside an accelerating structure. The accelerated electrons typically enter a resonant cavity having a resonant frequency f, exciting the electrons to higher energy. A high-current electron beam is thus generated at an output port of the resonant cavity for injection into a high-power accelerator.

The optical frequency $\upsilon$ of the laser illuminating the photocathode must be chosen so that the incident photon energy $h\upsilon$ is larger than the work function of the photocathode material. The work function is a property of the emitting surface of the photocathode. The choice of laser, therefore, is dependent on the photocathode materials available. Unfortunately, the more reliable photocathode materials typically require more intense and higher frequency laser illumination. A reliable, efficient, long-life high power laser and photocathode combination capable of generating high-current low-emittance electron beams is not known in the prior art.

In addition, high radio frequency (RF) power is required to generate a high accelerating RF field at the photocathode in a high-energy particle accelerator. In those accelerators equipped with normal conducting RF cavities, therefore, the RF guns are limited to pulsed operation with a low duty cycle, typically below $10^{-4}$. There have been attempts to overcome this limitation by using a superconducting acceleration cavity, which in principle enables operation in a continuous wave (CW) mode with the same beam quality.

RF photoinjectors with superconducting cavities operating in CW mode, therefore, are desired for use in high-average-current injectors. The superconducting cavity can advantageously maximize the electric field for good emittance properties and minimize power consumption. The sensitivity of the superconducting cavity, however, imposes even more constraints on the photocathode. For example, in order to preserve the high field characteristics of the cavity, the photocathode must not contaminate the cavity with particles from the photoemissive layer. In addition, the photocathodes must be characterized by a high quantum efficiency (QE) and long life time. The heat load imparted to the photocathode by the laser and the high electric fields must also be efficiently transferred from the photocathode, to allow an electron bunch to be emitted from the cathode with low thermal emittance.

There is a need, therefore, which is lacking in the prior art, for a reliable and efficient long-life electron gun for the generation of high-current high-brightness electron beams. There is a particular need for long-life, non-contaminating cathodes, especially photocathodes, which can be used in superconducting RF electron guns for the generation of high-current high-brightness electron beams.

SUMMARY OF THE INVENTION

The present invention addresses the need, which is unmet in the prior art, for a reliable and efficient long-life electron gun for the generation of high-current high-brightness electron beams. The present invention also addresses the need, unmet in the prior art, for efficient, long-life, non-contaminating cathodes, especially photocathodes, which can be used in electron guns, including superconducting RF electron guns, for the generation of high-current high-brightness electron beams.

The present invention relates to an electron gun for generating an electron beam, which includes a secondary emitter that emits secondary electrons in response to receiving a primary beam of primary electrons. The secondary emitter further includes a non-contaminating negative-electron-affinity material and a non-contaminating enhanced negative-electron-affinity emitting surface. The electron gun further includes an accelerating region, which generates the electron beam by accelerating the secondary electrons in an electric field. The enhanced negative-electron-affinity surface emits the secondary electrons into the accelerating region. The primary beam is generated externally to the accelerating region.

The present invention also relates to an electron gun for generating an electron beam, which includes a plurality of secondary emitters. A first of the plurality of secondary emitters emits secondary electrons in response to a primary beam of primary electrons. The primary beam is produced by a cathode disposed outside an accelerating region into which the secondary electrons are emitted. Each of the plurality of secondary emitters further includes a negative-electron-affinity material having an enhanced negative-electron-affinity emitting layer. The plurality of secondary emitters is arranged to emit a multiplicity of secondary electrons in response to secondary electrons emitted by at least one of the secondary emitters. The secondary emitters are disposed in cascading fashion to produce a multiplicative current gain.

The electron gun also includes at least a portion of a back wall of the accelerating region, where the accelerating region generates the electron beam by accelerating the multiplicity of secondary electrons in an electric field. The back wall of the accelerating region includes a last of the plurality of secondary emitters, which emits the multiplicity of secondary electrons into the accelerating region. The negative-electron-affinity material of the last secondary emitter includes one of single crystal diamond, polycrystalline diamond, and diamond-like carbon. The negative-electron-affinity enhanced surface of the last emitter includes terminated hydrogen bonds.

The present invention additionally relates to a radio frequency (RF) electron gun for generating an electron beam, which includes a photocathode. The photocathode emits primary electrons in response to a laser beam. The electron gun further includes a drift region in which the primary electrons are accelerated to a desired energy by a radio frequency field. The electron gun also includes a secondary emitter, which includes a non-contaminating negative-electron-affinity material, an input surface and a non-contaminating negative-electron-affinity enhanced emitting surface including hydrogen bonds. The input surface receives the primary electrons, and the emitting surface emits secondary electrons in response to the input surface receiving the primary electrons. The input surface includes a substantially uniform electrically conductive layer, which provides a replenishing current to the emitter and which is substantially transparent to the primary electrons. The RF gun further includes a radio frequency cavity, which may be superconducting, into which the secondary electrons are accelerated from the emitting surface by the radio frequency field of the cavity.

The present invention also relates to an encapsulated secondary emission enhanced cathode device for generating an electron beam including secondary electrons. The secondary emission enhanced cathode device includes a housing, and is disposed in a vacuum within the housing. The encapsulated cathode device, also includes a cathode, which includes a primary emission surface. The cathode is adapted to emit primary electrons from the primary emission surface, which is disposed within the vacuum of the housing. The device also includes a drift region. The primary electrons are accelerated to a desired energy in the drift region by an electric field. The encapsulated cathode device further includes a secondary emitter having a secondary emission surface that includes a non-contaminating enhanced negative-electron-affinity surface. The secondary emission surface emits secondary electrons in response to primary electrons impinging on the secondary emitter.

The present invention relates additionally to an encapsulated secondary emission enhanced cathode device for generating secondary electrons, which includes a housing that encapsulates the device within a vacuum, so that the primary emission surface of the cathode is disposed within the vacuum of the housing. The cathode includes a primary emission surface, and is adapted to emit primary electrons therefrom.

The cathode device also includes a first secondary emitter, which includes a first secondary emission surface that includes an enhanced negative-electron-affinity surface. The first secondary emission surface emits secondary electrons in response to primary electrons impinging on the first secondary emitter. The device also includes a final secondary emitter having a final secondary emission surface, which includes a non-contaminating enhanced negative-electron-affinity surface. The final secondary emission surface emits a plurality of secondary electrons in response to secondary electrons impinging on the final secondary emitter.

The present invention relates also to a secondary emission radio frequency (RF) electron gun system for generating an electron beam, which includes a laser, an encapsulated secondary emission enhanced photocathode device for generating secondary electrons in response to primary electrons, and a radio frequency (RF) cavity powered by a radio frequency source. The encapsulated secondary emission enhanced photocathode device is disposed in a back wall of the RF cavity, which generates the electron beam by accelerating the primary electrons to the secondary emitter, accelerating the secondary electrons through the emitter, and accelerating the secondary electrons emitted from the encapsulated secondary emission enhanced photocathode device.

The secondary emission enhanced cathode device includes a housing. The enhanced photocathode device is disposed in a vacuum within the housing. The cathode device further includes a photocathode, which includes a primary emission surface that emits primary electrons in response to the laser beam impinging on the photocathode. The primary emission surface is disposed within the vacuum of the housing. The device also includes a drift region. The primary electrons are accelerated to a desired energy in the drift region by the radio frequency field from the RF cavity. The cathode device also includes a secondary emitter having a secondary emission surface, which includes a non-contaminating enhanced negative-electron-affinity surface, and which emits secondary electrons in response to primary electrons impinging on the secondary emitter. The cathode device additionally includes a substantially uniform electrically conductive layer superposed on the secondary emitter. The electrically conductive layer provides a replenishing current to the secondary emitter and is substantially transparent to the primary electrons.

Photocathode materials of the present invention include high quantum efficiency photoemissive materials, which include at least one of cesium potassium antimonide ($CsK_2Sb$), metals, multialkali, alkali telluride, alkali antimonide, multialkali antimonide, and cesiated semiconductor. In the electron gun and electron gun system of the present invention which include a photocathode emitting primary electrons in response to a laser, at least one of an electron energy, an electron bunch length, a spatial charge distribution, and a temporal distribution of the electron beam emitted from the gun may be substantially controlled by the laser.

A non-contaminating secondary emitter of the present invention includes one of single crystal diamond, polycrystalline diamond, and diamond-like carbon. The non-contaminating negative-electron-affinity enhanced surface includes terminated hydrogen bonds.

The present invention also includes a method for generating an electron beam including the steps of: providing a primary beam including primary accelerated electrons, in which the primary beam is substantially directed at a secondary emitter; emitting secondary electrons from the secondary emitter in response to contact with the primary accelerated electrons; and generating the electron beam by accelerating the secondary electrons in an accelerating region. A cathode providing the primary beam is disposed external to the accelerating region.

The present invention also includes a method for generating a high-brightness high-current electron beam, which includes the steps of: inserting an encapsulated secondary emission enhanced cathode device into a radio frequency accelerating cavity, where the encapsulated secondary emission cathode device includes a high quantum efficiency cathode and a non-contaminating secondary emitter; adapting the high quantum efficiency cathode to emit primary electrons, where the non-contaminating secondary emitter emits secondary electrons in response to the primary electrons; and providing an electric field to accelerate the primary electrons to the input surface of the secondary emitter, and to accelerate the secondary electrons through the emitter. The secondary electrons emitted from the encapsulated secondary emission enhanced cathode device are also accelerated by the electric field to generate the high-brightness high-current electron beam.

The present invention additionally relates to a lasertron for providing radio frequency power. The lasertron includes a photocathode which emits primary electrons in response to a laser beam, a secondary emitter, an anode, and an extraction cavity. Secondary electrons are emitted from an emitting surface of the secondary emitter and accelerated to the anode by a direct current field applied between the emitter and the anode. The extraction cavity receives the secondary electrons and provides radio frequency power output.

The secondary emitter of the lasertron includes a non-contaminating negative-electron-affinity material, an input surface, and the emitting surface, which includes a non-contaminating enhanced negative-electron affinity surface. The input surface receives the primary electrons. The input surface includes a substantially uniform electrically conductive layer, which provides a replenishing current to the secondary emitter, and which is substantially transparent to the primary electrons.

As a result, the present invention provides a reliable and efficient long-life electron gun and electron gun system for the generation of high-current high-brightness electron beams. The present invention also provides efficient, long-life, non-contaminating cathode devices, including high quantum efficiency photocathode devices, which can be used in electron guns, including superconducting RF electron guns, for the generation of high-current high-brightness electron beams.

DETAILED DESCRIPTION OF THE INVENTION

The device formed in accordance with the present invention provides a secondary emission electron gun powered by a primary electron beam. A secondary emission electron gun system formed in accordance with the present invention includes the secondary emission electron gun and a source of primary electrons.

Figure 1:
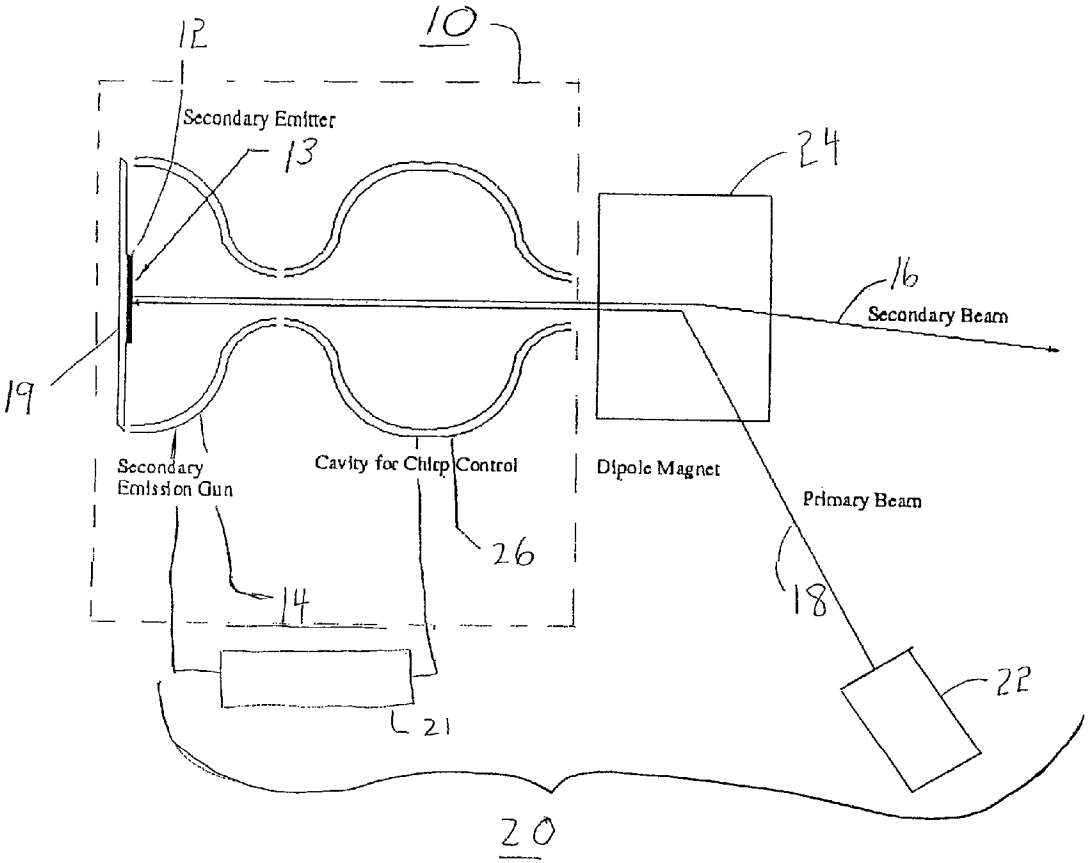
FIG. 1 is a schematic representation of an embodiment of an electron gun and an electron gun system formed in accordance with the present invention, the gun operating in a reflection mode.

FIG. 1 is a schematic representation of an embodiment of an electron gun 10 for generating an electron beam formed in accordance with the present invention. The electron gun 10 includes a secondary emitter 12, which includes a non-contaminating negative-electron-affinity material, and an accelerating region. The secondary emitter 12 includes an emitting surface 13. The accelerating region includes a radio frequency (RF) cavity 14 in the embodiment shown in FIG. 1 The secondary emitter 12 produces secondary electrons in a secondary beam 16 in response to a primary beam 18 which includes primary electrons. A cathode emitting the primary electrons is disposed external to the accelerating region 14. The primary beam 18 is thus produced outside the accelerating region 14 in which an electric field is generated for accelerating the secondary electrons.

In the embodiment shown in FIG. 1, the electron gun 10 operates in a reflection mode, with the primary beam 18 incident on a front side including the emitting surface 13 of the secondary emitter 12. Secondary electrons are emitted in the secondary beam 16 in an opposite direction, i.e. at substantially 180 degrees, to a direction of the incident primary beam 18. A back wall 19 forms one end of the accelerating region or cavity 14. Preferably, at least a portion of the back wall 19 includes the secondary emitter 12. In this embodiment, no contamination of the cavity 14 by a cathode producing the primaries can occur. The lifetime of neither the cathode nor the main accelerator receiving the secondary beam 16 is, therefore, degraded by contact with the other.

When bombarded with primary electrons, the secondary emitter 12 emits a number of secondary electrons (secondaries) from the secondary emitter, which is substantially equal to a gain factor times the number of primary electrons (primaries) incident on the emitter 12. This gain factor is called the Secondary Emission Yield (SEY) and is defined as the average number of secondaries emitted for each incident primary electron. The SEY is a material property, which depends also on the energy of the primary electrons. As the primary electron energy increases, the SEY increases up to a maximum peak SEY at energy $E_{max}$, and then generally, monotonically decreases for primary electron energy greater than $E_{max}$.

Preferably, therefore, the secondary emitter 12 of the present invention is characterized by an SEY equal to or greater than about 1. Most preferably, the SEY is greater than about 10 so that the gun 10 of the present invention advantageously uses the emitter 12 to both isolate the cathode from the cavity 14 (preventing contamination) and to amplify the electron yield.

The secondary emitter 12 of the present invention includes a negative-affinity-electron (NEA) material, which has an enhanced NEA surface to ease the secondaries across the surface barrier of the emitting surface 13. An NEA material is any material having a work function at its surface which is less than the bandgap of the bulk material. As is known to those skilled in the art, the enhanced surface of the NEA material is prepared by treating it with a substance, such as cesium, so that the surface barrier is reduced and so that band-bending occurs until the top of the conduction band lies above the vacuum level, ensuring that the electron affinity of the material is lowered, and preferably, negative.

Cesium, oxygen, and hydrogen are examples of well-known enhancers. These electropositive elements can atomically clean the surface of a semiconductor material, removing the work function barrier at the surface.

The emitter 12 of the present invention, when disposed as in FIG. 1 to be part of the cavity 14, includes any non-contaminating negative-electron-affinity material capable of generating secondary electrons. Preferably, the NEA material includes at least one of (single-crystal) diamond, diamond-like carbon (DLC), nano-crystalline, and polycrystalline diamond which are all non-contaminating emitters. The emitter 12 may be a diamond film formed by chemical vapor deposition or by other means known to those skilled in the art as described, e.g., in A. Shih, et al., "Secondary Electron Emission from Diamond Surfaces," *J. Appl. Phys.* Vol. 82, No. 4, pp. 1860-1867 (Aug. 15, 1997), which is incorporated herein by reference.

The emitting surface 13 of an emitter 12 of this type in accordance with the present invention is non-contaminating to the cavity 14. Preferably, the NEA of the emitting surface 13 is enhanced by hydrogenation, a process well-known to those skilled in the art, in which hydrogen bonds terminate the emitting surface of such diamond and diamond-like materials, as described, for example in A. Shih, et al.

The NEA of the emitter 12 may be enhanced by decreasing the work-function of the emitting surface layer 13 of the emitter. 12 by any means known to those skilled in the art, as long as the emitting layer 13 is non-contaminating to the cavity 14.

In a most preferred embodiment, the emitter 12 includes pure single-crystal diamond.

The SEY of the secondary emitter 12 and emitter 42 (see FIG. 2) of the present invention depends on the material, and on the energy of the primary electrons. For example, for a hydrogenated boron-doped polycrystalline diamond emitter of the present invention, with a low doping concentration, the SEY is about 50 for an incident electron energy of 2.0 keV, and the SEY is about 80 at 5.0 keV. The SEY of an NEA material typically increases with energy up to a maximum value, and then monotonically decreases.

In one embodiment, the secondary emitter 12 has an SEY equal to or greater than about 1.

In another embodiment, the emitter has an SEY equal to or greater than about 30.

In another embodiment, the emitter 12 has an SEY equal to or greater than about 50.

In yet another embodiment, the emitter 12 has an SEY equal to or greater than about 80.

A thickness of the emitter 12 is preferably less than about 100 microns.

In one embodiment, the thickness of the emitter 12 is equal to or less than about 10 microns.

In another embodiment, the thickness of the emitter 12 is greater than or equal to about 10 microns and less than or equal to about 100 microns.

Figure 2:
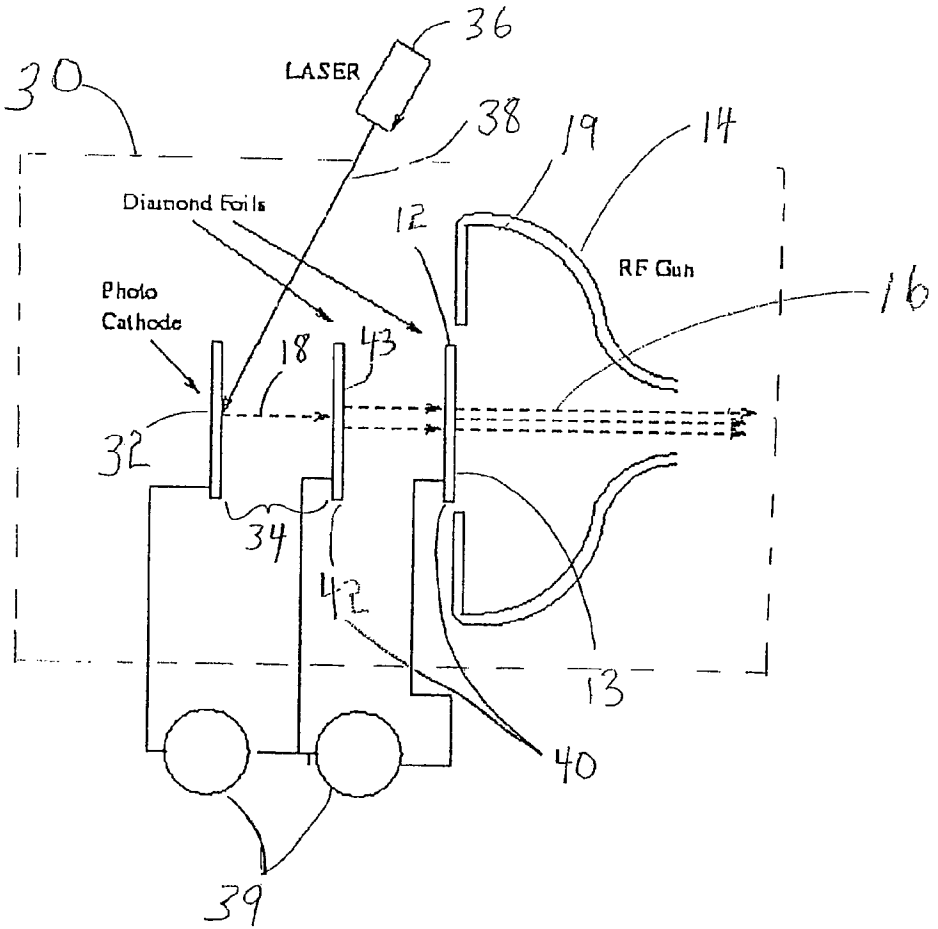
FIG. 2 is a schematic representation of another embodiment of an electron gun and electron gun system formed in accordance with the present invention, the gun operating in a transmission mode.

Though a single secondary emitter 12 is shown in the embodiment 10 of FIG. 1, in another embodiment, multiple secondary emitters may be stacked as shown in FIG. 2 and used in this reflection mode to multiply the current gain of the accelerated beam 16.

In another embodiment, an electron gun system 20 includes the electron gun 10, an accelerating source 21, e.g. an RF source, and preferably, a primary electron source 22. The electron source 22 generates the primary beam 18, which is then guided toward the secondary emitter 12. The primary beam 18 is directed into the cavity 14, preferably by a dipole magnet 24 and accelerated toward the emitter 12 by an electric field generated by the accelerating source 21.

The externally-generated primary beam 18 may be guided onto the secondary emitter 12 by means known to those skilled in the art, such as the dipole magnet 24 shown in FIG. 1. The dipole magnet 24 is used to guide the primary beam 18 onto the front side 26 as well as to steer the secondary beam 16 injected, for example, into a high-energy particle accelerator. By properly synchronizing the timing of arrival of primary electrons of appropriate energy at the secondary emitter 12 with the accelerating field of the accelerating region 14, the secondary beam 16 can be effectively accelerated, by means known to those skilled in the art, in a direction opposite the acceleration of the primary beam 18.

Though the accelerating region 14 in the embodiment of the gun 10 shown in FIG. 1 is an RF cavity, in another embodiment, the system 20 may be powered by a DC source to accelerate the electrons emitted by the emitter 12, by applying a DC voltage corresponding to the desired electron beam energy between a conducting surface of the secondary emitter 12 and an external anode (not shown) for example, a ring-type anode, in the accelerating region 14.

The system 20 may be used as an injector for coupling to any high-energy accelerator, for example, a linear accelerator (LINAC). The electric field for accelerating the secondary beam 16 after injection into an accelerator proper 62 (see FIG. 3), e.g., the LINAC portion of the high-power accelerator, is typically an RF source. The same type of RF source may be used to power both the gun accelerating region 14 and the LINAC, or a DC source with a voltage potential applied between the emitter 12 and a ring anode may be used as described above.

In a preferred embodiment shown in FIG. 1 and in FIG. 2, the accelerating region is a radio frequency (RF) cavity 14, powered by an RF source to both accelerate the secondary electrons through the emitter 12 and into the cavity 14 and into an accelerator proper (or the main accelerator) of, for example, a high-energy accelerator. The primary electrons may also be accelerated to the secondary emitter 12 by the RF field.

An RF cavity 26 preferably receives RF energy from the RF source, a klystron for example, and transfers the energy to the primary electrons as they pass through the cavity 26 and also produces a chirp. The RF cavity 14 decelerates the primaries, removes the chirp, and also accelerates the secondary electrons. The resulting beam of electrons injected into the main accelerator from the cavity 14 may differ slightly in energy, but will have substantially the same phase, with a substantial amount of the beam intensity concentrated close to the reference phase of the buncher in the main accelerator. The main accelerator will then quickly accelerate the electrons to higher relativistic energies, rendering any initial energy spread insignificant, and introducing substantially no new phase spread.

The RF cavity 14 is preferably designed with a resonant frequency substantially matching the desired frequency of the electron bunches emitted. In a pulsed RF high-energy accelerator system, the repetition rate of the laser is matched to the repetition rate of the RF. In a CW RF system using a mode-locked laser, for example, the frequency of the RF is matched to (equivalent to or a multiple of) the mode-locked laser emission. As each bunch of secondary electrons enters the RF cavity 14, the bunch is then accelerated by the RF voltage.

In the most preferred embodiment, the RF cavity 14 of the present invention is a superconductive RF cavity, preferably for use in a CW superconducting RF high-energy accelerator.

The electron source 22 in the gun system 20 of FIG. 1 may be any source capable of generating a primary electron beam 18. The electron source includes a cathode. The primary electrons are preferably accelerated by an electric field generated between the cathode and the secondary emitter 12.

In one embodiment, the source 22 is a thermionic emission source, which typically consists of a heated cathode. The cathode includes an aperture for passing the thermally-generated primary electrons.

In another embodiment, the source 22 is a field emission source, typically a needle-shaped emitter which emits electrons when excited by an extremely high electric field.

In a preferred embodiment, the source 22 is a photoemissive source, which includes a photon source and a photocathode. Preferably, the photon source includes a laser.

In a preferred embodiment, the laser is a mode-locked laser.

For high-energy physics and nuclear physics research, it is often required that the spin of the electrons in the electron beam from an electron gun be polarized. A polarized beam could be produced in a photoemission gun using an appropriate photocathode material, but, unfortunately, the known photocathode materials capable of producing polarized electrons in response to a laser are characterized by poor life time. The beam current is, therefore, limited by the available laser power.

In another embodiment of the present invention, therefore, an electron gun operating in reflection mode as shown in FIG. 1, is adapted to produce a polarized electron beam. The cathode is preferably a high quantum efficiency photo cathode. The emitting surface of the secondary emitter of the polarizing electron gun of the present invention comprises any material which produces a high degree of polarization in response to primary electrons. In a preferred embodiment, the emitting surface comprises europium. In this configuration, an unpolarized primary beam provides sufficient power for the production of a high current polarized secondary beam.

Referring to FIG. 2, an alternate embodiment of an electron gun 30 for generating an electron beam formed in accordance with the present invention includes the secondary emitter 12 and the accelerating region 14 operating in a transmission mode.

Referring to FIG. 2, the secondary emitter 12, which includes non-contaminating NEA material, produces secondary electrons in the secondary beam 16 in response to the primary beam 18 which includes primary electrons. The primary beam 18 is produced outside the accelerating cavity 14 in which an electric field is generated for accelerating the secondary electrons of the electron beam 16. The device 30 includes a cathode 32 located behind a secondary emitter 12. In this embodiment, the primary electron beam 18 is generated in the same direction as the secondary beam 16.

The cathode 32 may be any cathode capable of emitting primary electrons, excited by an appropriate source for production and emission of primary electrons.

A drift region 34 is preferably included, in which the primary electrons are accelerated to a desired energy by an electric field. The drift region 34 extends from the cathode 32 to an input surface of the secondary emitter receiving the primary electrons. The primary electrons are accelerated and injected into the emitter 12.

The charge extracted from the secondary emitter 12 of the present invention can be quite large. It is necessary, therefore, to provide a means to replenish the extracted charge to avoid charging of the diamond.

Charging of polycrystalline diamond films has been avoided by doping the diamond with, for example, boron, in prior art experiments, such as described in Yater, et al, "Transmission of Low-Energy Electrons in Boron-Doped Nanocrystalline Diamond Films," *Journal of Appl Phy*., Vol. 93, No. 5, pp. 3082-3089 (Mar. 1, 2003), which is incorporated herein by reference. In the prior art, however, the extracted charge was very small, and the diamond was not being used as a secondary emitter in an RF cavity. Boron-doping may reduce the transmission of primary electrons due to capture of electrons by holes supplied by the dopant, causing RF losses in boron-doped diamond films used as a secondary emitter in an RF gun. In the present invention, therefore, doping is not a preferred method of replenishing the extracted charge from the secondary emitter.

A replenishing current is preferably provided to the secondary emitter of the present invention by a substantially uniform electrically conductive layer 88 (see FIG. 4*c*) superposed on an input surface of each secondary emitter of the present invention. The uniform conductive layer 88 advantageously reduces charge loss due to collision, and increases the overall yield. The electrically conductive layer 88 is preferably thin enough to be substantially transparent to the injected primary electrons and the RF field, yet conductive enough to replenish the charge. If the layer 88 is substantially transparent to the primary electrons, the injection of the primary electrons into the bulk of the emitter will not be impeded by the presence of the conducting layer. The conductive layer 88 is also substantially transparent to injected secondary electrons, e.g., into emitter 42, in the embodiment which includes a plurality of secondary emitters 40.

By making the conductive layer 88 (see FIG. 4*c*) thin to the RF field in an RF electric gun of the present invention, an electric field is established through the entire diamond emitter 12. The electric (RF) field accelerates the primaries in the drift region 34 and injects them into the secondary emitter, transports the secondary electrons through the bulk of the diamond to the emitting surface 13, and accelerates the secondary electrons from the emitting surface 13. This applied field through the emitter 12 improves the secondary electron transport to the extent that a much lower primary electron energy is required to produce a minimal gain than has been reported in the prior art. For example, Yater, et al. reports that a primary energy of 18 keV is required to exceed a SEY gain of about 3 from a boron-doped polycrystalline diamond film. A diamond emitter 12 of the present invention, in contrast, is expected to have a gain of about 80 with a primary electron energy of about 5 keV.

In yet another embodiment shown in FIG. 2, an electron gun system 35 includes the electron gun 30 and a laser 36, which generates a photon beam 38. The photon bean 38 is directed onto the cathode 32 which generates the primary electrons 18 in response thereto. The system 35 may also include at least one high-voltage power supply 39 for applying a voltage potential between the cathode 32 and the secondary emitter 12 to provide the electric field (DC electric field), which accelerates the primary electrons in the drift region 34 toward the secondary emitter.

Any photocathode/laser combination known to those skilled in the art may be used to generate the primary beam 18. The cathode 32, therefore, may include any photocathode material which produces electrons in response to illumination by a photon source. Photocathode materials include, but are not limited to metals, multialkali, alkali telluride, alkali antimonide, multialkali antimonide, and cesiated semiconductors.

A preferred photocathode includes at least one of a multialkali antimonide, e.g., cesium potassium antimonide ($CsK_2Sb$), and is characterized by a high quantum efficiency.

The RF cavity 14 may be a normal conducting or a superconducting cavity. In addition, the RF source may be pulsed or continuously operating (CW). In a pulsed RF system, the RF power source is preferably pulsed substantially synchronously with the laser, in order to produce an electron beam pulse substantially at a peak or optimum electric field gradient of the RF source. The timing of the electron beam 16 injected into the accelerating cavity 14 is driven by the timing of the laser-generated pulses. At least one of the electron beam energy, an electron bunch length, a spatial charge distribution, and a temporal distribution of the electron beam emitted from the RF gun 30 is preferably controlled by controlling the laser 36 and its properties.

In the most preferred embodiment applicable to both FIG. 1 and FIG. 2, the primary beam 18 is generated by a photocathode (which is part of the emission source 22 in FIG. 1) in response to a laser beam 38 incident thereon. The laser 36 includes a mode-locked CW laser. The primary electrons are accelerated to the desired energy in the drift region to the input surface of the secondary emitter receiving the primary electrons, by an RF field powering the cavity. The RF field also accelerates the secondary electrons through the secondary emitter 12. The secondary electrons emitted from the surface 13 are accelerated in the RF cavity, which is preferably superconducting.

The secondary emitter 12 includes any non-contaminating enhanced NEA material. Preferably, the emitter 12 includes one of diamond, DLC, and polycrystalline diamond, with a hydrogenated enhanced NEA surface 13. Most preferably, the emitter 12 includes hydrogenated single crystal diamond, i.e. diamond with a hydrogenated enhanced NEA surface 13.

A superconducting accelerating cavity advantageously enables CW operation of the RF source with the same beam quality. The pulse length, intensity, and energy of the electron beam are then preferably controlled by controlling the laser properties.

Still referring to FIG. 2, another embodiment of a device 35 for generating an electron beam 16 formed in accordance with the present invention includes a plurality of secondary emitters 40.

At least one 42 of the secondary emitters 40 produces secondary electrons in response to contact with a primary beam 18 which includes primary electrons generated outside the accelerating region 14. The remainder of the plurality of secondary emitters 40 are disposed in a cascading fashion, with the output of one used as the input to the next, and so on, as shown in FIG. 2, to produce a multiplicity of secondary electrons from a final emitter 12. In other words, a gain, or increase, in the number of secondary electrons generated at each secondary emitter 40 results in a multiplicity of secondary electrons finally emitted, along with a corresponding increase in current, in response to contact with incident electrons. The result is a dramatic increase in the current gain of the combined device 30. The last emitter 12 includes any non-contaminating NEA material, as described above.

The primary electrons are preferably accelerated to a desired energy in a drift region 34 to the secondary emitter by an electric field. An electric field is also provided to accelerate secondaries through and from the plurality of secondary emitters 40.

FIG. 2 shows two secondary emitters, one 42 which is in isolation from the cavity 14, and one 12 which is part of the cavity 14. It is understood that an electron gun of the present invention may include more than one emitter disposed in cascading fashion before the final emitter 12.

The isolated emitter(s) 42 may include at least one of magnesium oxide (MgO), one of the type III-Nitrides, which are described by $Al_xGa_{1-x}N$ (where $0 \leqq x \leqq 1$), and gallium phosphide (GaP), as well as diamond, DLC and polycrystalline (including nan-crystalline) diamond. These materials may be undoped or doped for enhanced SEY. The secondary emitter 42 of this type may include cesium, hydrogen or other enhancers to enhance the NEA of the surface 43. The secondary emitter 42, especially if it includes cesium to enhance the surface NEA, is preferably further encapsulated in vacuum to avoid contamination of the cavity 14.

In one embodiment, the secondary emitter 42 includes hydrogenated boron-doped polycrystalline diamond, and the enhanced NEA surface 43 is formed by either hydrogenation or cesiation.

The device 35 preferably includes at least a portion of the back wall 19 of the accelerating region 14, the back wall 19 forming one end of the accelerating region or cavity 14 as shown in FIG. 2. The at least the portion of the back wall 19 includes the last 12 of the plurality of secondary emitters 40.

The accelerating cavity 14 generates the electron beam 16 by accelerating the multiplicity of secondary electrons.

In the most preferred embodiment having an RF superconducting cavity 14, the emitter 12 includes pure diamond with a hydrogenated enhanced NEA surface 13. The diamond of the secondary emitter 12 is preferably of substantially high quality and relatively free of defects. A high quality diamond emitter advantageously reduces RF power loss, promotes good thermal conductivity in the diamond, and optimizes optical transmission and mechanical strength.

In another embodiment, the emitter 12 includes polycrystalline diamond, preferably of substantially large grain size. Mechanical strength, transmission of electrons through the diamond and thermal conductivity advantageously increase with increasing grain size.

In yet another embodiment, a compact x-ray source is provided. The cathode 32 includes a field emission cathode excited by a high electric field to emit electrons. A plurality of secondary emitters 40 emits secondaries, and a high-voltage supply 39, e.g. 3-kV supply, provides a DC field for acceleration of electrons onto each successive emitter 12. A ring anode (not shown) is provided onto which the secondaries are accelerated, with the accelerating region 14 being between the last emitter 12 and the ring anode, in the place of the RF cavity shown in FIG. 2. The anode preferably comprises one of a low Z material, e.g. carbon, and a high Z material, e.g., tungsten, which produces x-rays in response to being bombarded by secondaries. This embodiment describes a compact table-top, or a hand-held type of x-ray source.

In accordance with FIG. 1 and FIG. 2, a method for generating a high-current high-brightness beam in accordance with the present invention includes providing a primary beam 18 of primary electrons from a cathode 32. The primary beam 18 is substantially directed at a secondary emitter 12. The method includes generating secondary electrons from the secondary emitter 12 in response to contact with the primary electrons, and accelerating the secondary electrons in an accelerating cavity 14. The primary beam is generated outside the accelerating cavity 14.

Figure 3:
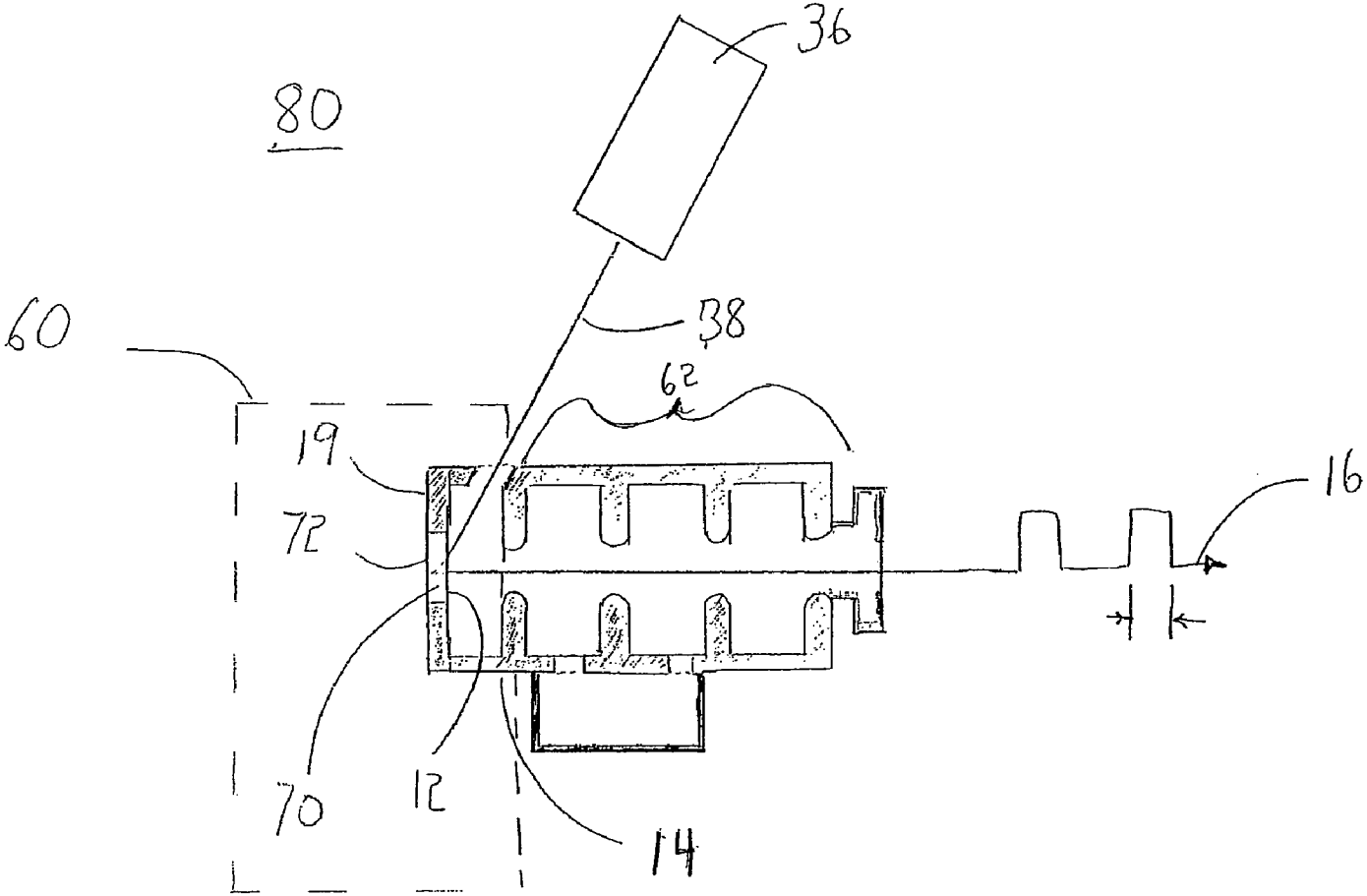
FIG. 3 is a schematic representation of a preferred embodiment of the electron gun of the present invention, shown as an injector for a linear accelerator (LINAC) system.

Referring to FIG. 3, the most preferred embodiment 60 of the electron gun of the present invention is a laser photocathode superconducting RF gun operated in continuous wave (CW) mode. The RF-powered gun 60 is capable of producing the required high brightness electron beam (or low emittance at high bunch charge) for injection into a main accelerator portion 62 of a high-energy accelerator-based system, e.g. a LINAC or an X-ray FEL, due to the high electric field that may be achieved in the RF gun, which is the key factor in getting a large charge with a small emittance.

The photocathode and its associated laser are, arguably the most difficult aspect of designing a reliable and efficient laser-photocathode electron gun. Robust, metallic cathodes are popular in RF guns that operate at a very low average current. They are usually driven in the near UV, typically at about 0.25 microns. This illuminating wavelength is typically obtained by frequency quadrupling a 1 micron laser, which is itself a wasteful process.

Semiconducting photocathodes, on the other hand, can provide very high Quantum Efficiency (QE) at longer wavelengths between 1 to 0.5 microns (IR to green light). For example, a QE of about 10% is available in semiconducting photocathodes illuminated with green light. Since high-power lasers that operate in this wavelength range are readily available, the semiconducting photocathodes are more desirable for use in high average current guns. Other problems are associated with these cathodes when used as photoemitters in electron guns, however. First, they are very sensitive to any contamination and thus must be prepared and maintained under ultra-high vacuum conditions. If the vacuum in the gun is less than pristine, therefore, these cathodes may suffer a short lifetime.

In addition, when used in superconducting guns, the chemicals on the cathode surface (most commonly, e.g., cesium) may degrade the superconducting gun surface, which, in turn, degrades the performance and lifetime of the electron gun. Finally, even with the extremely good QE available with such cathodes, the associated CW laser required to illuminate these cathodes for photoemission is formidable, requiring a few 10's of watts CW with some exacting demands on pulse length, stability and more.

In order to produce a high average current, it is desirable to operate the gun in a continuous mode. This can be accomplished by powering the accelerating cavity and the main accelerator, or accelerator proper, into which the electron beam is injected with a DC source, but the price to pay is a much lower electric field. The best duty factor demonstrated so far in normal conducting RF guns is about 25%. Guns with 100% duty factor are being researched, but again, the field strength is sacrificed due to the huge power that flows into the gun cooling system. The best candidate to a high brightness, CW gun, therefore, is the superconducting RF gun, using an RF source operated CW and a mode-locked CW laser to control bunch length and timing. Again, the problem of contamination of the gun by the cathode material has been a problem in past attempts in designing these systems.

Referring again to FIG. 3, the RF electron gun 60 formed in accordance with the present invention is a reliable and efficient long-life electron gun for the generation of high-current high-brightness electron beams. The gun 60 includes an efficient, long-life, non-contaminating secondary emission enhanced cathode device 70, which is particularly useful in CW superconducting RF electron guns.

The secondary emission enhanced cathode device 70 further includes a cathode 72, a drift region 94 (see FIG. 4*a*) and the secondary emitter 12 of the present invention.

In the preferred embodiment, as used in FIG. 3, the cathode 72 is a photocathode and generates primary electrons in response to an incident laser beam 38.

The secondary emitter 12 includes a non-contaminating negative-electron-affinity material and emits secondary electrons in response to the incident primary electrons. Primary electrons are received at an input surface 88 of the secondary emitter 12 and secondaries are emitted from the emitting surface 90 (see FIG. 4*c*). In the preferred embodiment of FIG. 3, the RF source powering the main accelerator generates an electric field and accelerates both the primary electrons and the secondary electrons.

An RF electron gun system 80 formed in accordance with the present invention includes the RF electron gun 60 and a laser 36 for generating the incident laser beam 38.

Figures 4A, 4B, 4C:
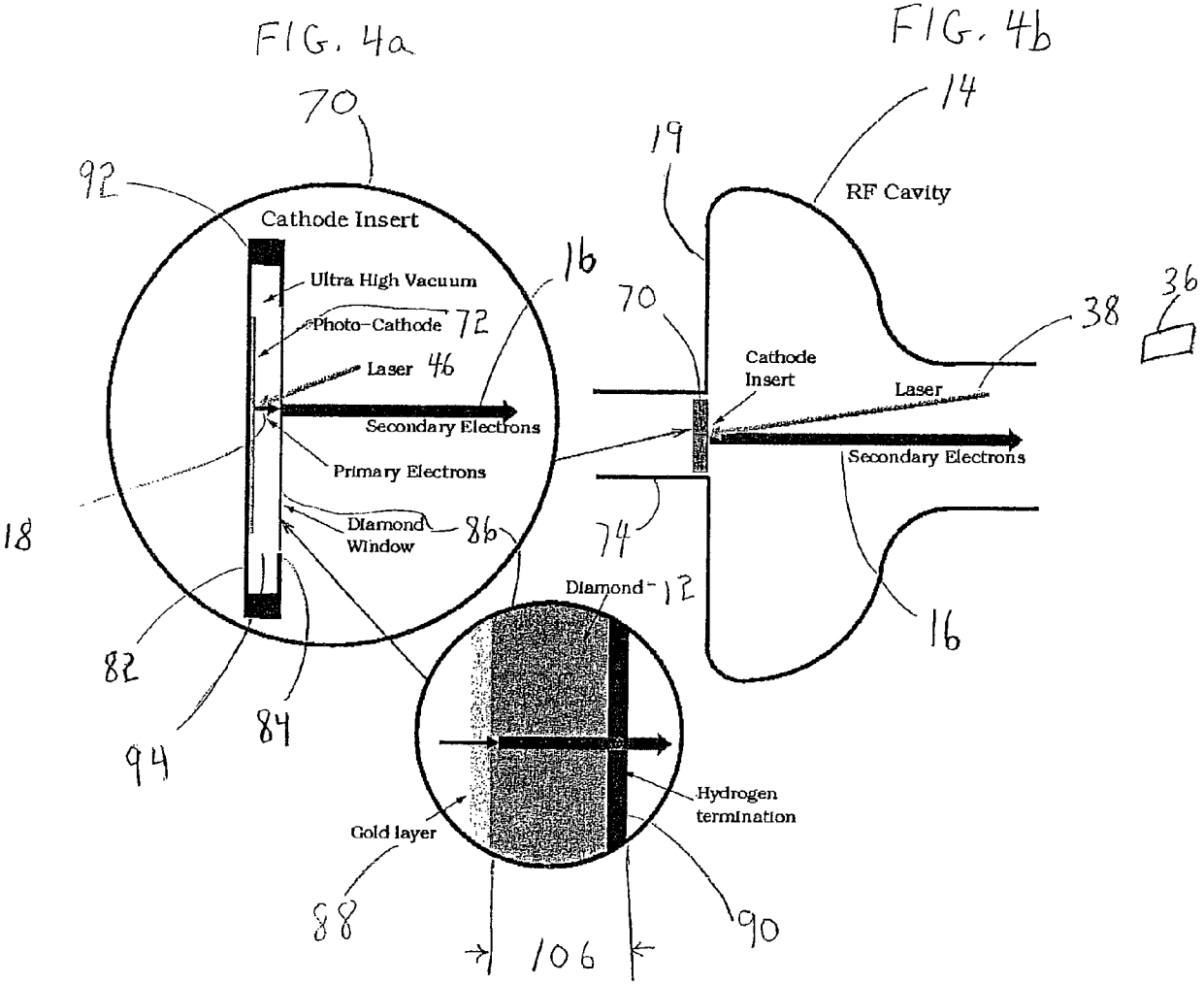
FIG. 4*a* is a side view of a secondary emission enhanced cathode device of the present invention.
FIG. 4*b* is a side view of the cathode device of FIG. 4*a* inserted into a radio frequency (RF) cavity of an electron gun of the present invention.
FIG. 4*c* is an enlarged side view of a window including a secondary emitter, of the cathode device of FIG. 4*a*.

Referring to FIG. 4*a*, an embodiment of the secondary emission enhanced cathode device 70 of the present invention is preferably encapsulated in vacuum, so that at least a portion of the cathode 72 is maintained under vacuum, and includes a first side 82 and an injection side 84.

The first side 82 includes the cathode 72 which generates primary electrons. Preferably, the cathode 72 is a photocathode, which generates primary electrons in response to an incident photon source, most preferably, a laser, as shown in FIG. 3.

In an alternate embodiment, the cathode 72 is any cathode or electron source used to generate electrons, and the secondary emission enhanced cathode device 70 is used to enhance the generation of the electrons. For example, the cathode may include a pulsed thermionic electron source or an X-ray source. A proper choice of cathode material and geometry can be made by one skilled in the art to match the primary electron source.

Referring to FIGS. 4*a*, 4*b*, and 4*c*, the basic operation of the cathode device 70 for the generation of secondary emission electrons will be the same, regardless of the primary electron source. The primary electrons generated by the cathode 72 strike the back side (input surface) of a window 86 which includes the secondary emitter 12, preferably at an energy of about a few keV, resulting in a large number of secondary electrons being produced in the secondary emitter 12.

The secondary emitter 12 is preferably one of single crystal diamond, polycrystalline diamond and diamond-like carbon with a hydrogenated enhanced NEA surface. Most preferably, the emitter 12 includes pure single crystal hydrogenated diamond. Secondary electrons are produced and transported across the bulk of the diamond, preferably by a superimposed electric field, and emerge to an accelerating gap of, for example, an accelerator-based system.

Regardless of the source of the primary electrons, the process of conversion of the primary electrons into secondary electrons wipes out the history of the primary electrons, leaving only a few characteristics: the current and bunch length of the primary electrons and the area of the diamond over which they are spread. The emittance of the primary electrons is, therefore, unimportant.

The injection side 84 includes a secondary emitter window 86 and a substantially uniform electrically conductive layer 88. The conductive layer 88 serves as an electric conductor to bring a replenishing current to the emitter 12 and is disposed on the input side of the diamond window 86 which accepts the primary electrons.

The window 86 includes the secondary emitter 12, which further includes any of the non-contaminating negative-electron-affinity material as described in the present invention. Most preferably, the window 86 includes pure diamond as the secondary emitter 12, with an enhanced negative-electron-affinity (NEA) emitting surface 90 which forms an outer layer of the window 86. Preferably, the diamond dangling bonds on the gun cavity side 84 of the device 70 are terminated by hydrogen, to provide the enhanced NEA surface 90 of the diamond 86. Secondary electrons are generated by the diamond 12 in response to the primary electrons, and are eased into the cavity 14 through the NEA surface 90.

The primary electrons are accelerated to a desired energy in the drift region 94 to the input surface of the window 86 by an electric field. The input surface includes the conductive layer 88. The secondary electrons are accelerated through the emitter 12 by the electric field to the emitting surface 90. The emitted secondaries are also accelerated by the field.

The transport of the secondary electrons through the diamond to the emitting surface 90 is essential for generating a high secondary electron yield (SEY). In the electron gun of the present invention, the electric field is applied through the entire diamond layer 12 to both transport and accelerate the secondary electrons generated. In the RF electron gun system 80 shown in FIG. 3, for example, the accelerating field is part of the RF field of the accelerator proper 62, so that an electric field for transporting the secondaries through the diamond is also supplied by the RF field of the accelerator 80.

Figure 6:
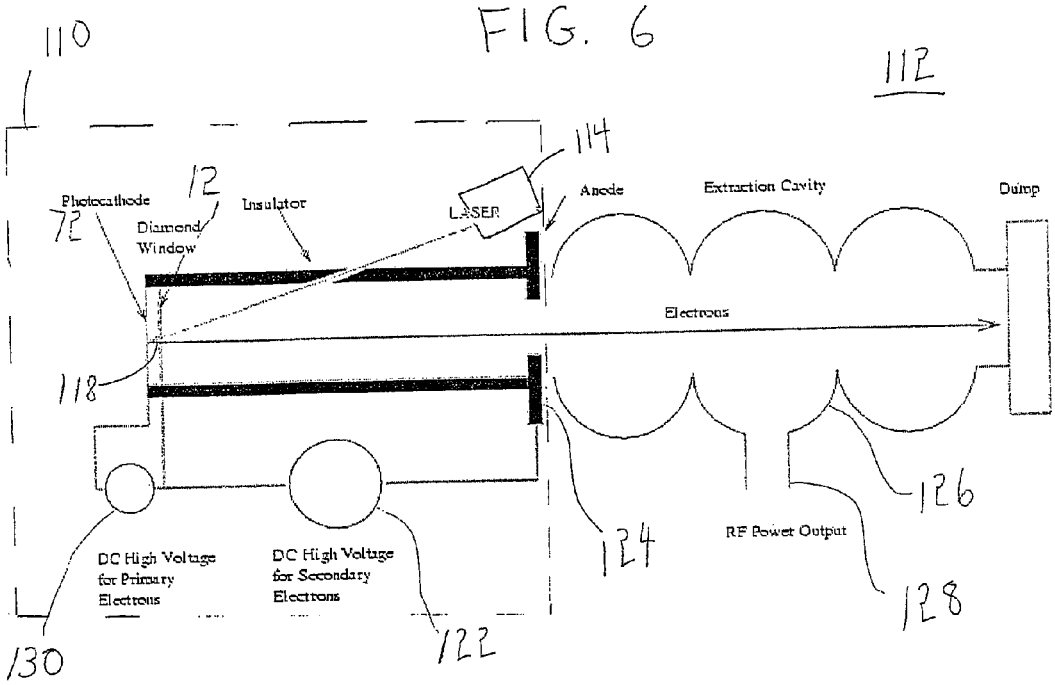
FIG. 6 is a schematic representation of a lasertron including an electron gun formed in accordance with the present invention.

In the electron gun system which uses a DC accelerating field, such as the gun 110 shown in FIG. 6, the conductive layer 88 also provides an electric field through the diamond to transport the secondary electrons generated in the diamond to the emitting surface 13. The DC voltage is applied between the conductive layer 88 on the secondary emitter 12 and the anode 124 to provide an accelerating field. Because the conductive layer 88 substantially uniformly covers the input surface of the emitter 12, the accelerating field, therefore, also provides the electric field to transport the secondary electrons through the diamond.

The conductive layer 88 is preferably thin enough to be transparent to the laser radiation and to the primary electrons, and to the cavity electric field, so that the presence of the conductive layer 88 will have a minimal effect on the primary electrons.

Most preferably, the conductive layer 88 is less than or equal to about 10 nanometers (nm) thickness.

In one embodiment, the conductive layer 88 includes at least one of gold and titanium nitride. However, the layer 88 may include any material having the property of good electrical conductivity, and which may be substantially uniformly superposed on the diamond emitter 12. The layer 88 is also preferably characterized by a low atomic number to minimize scattering of the primary electrons.

In another embodiment, the conductive layer 88 includes at least one of indium tin oxide, nickel, platinum, and palladium.

Preferably, the device 70, including at least the portion of the cathode 72, is maintained under vacuum, most preferably under ultra-high vacuum. The cathode 72 is, therefore, advantageously isolated from the RF cavity 14, preventing contamination of the cavity 14 and of the accelerator proper 62 (see FIG. 3) into which the electron beam may be injected from chemicals on the cathode 72. The non-contaminating cathode device 70 may advantageously be used in a superconducting gun cavity, making CW operation of an accelerator possible. Likewise, contamination of the cathode 72 by the cavity 14 is prevented, allowing the use of high quantum efficiency (QE) but sensitive cathodes.

In an additional embodiment, the RF electron gun incorporating a high QE cathode and preferably a superconducting cavity is adapted for use in a high-energy accelerator. The accelerator may produce a high average current, up to ampere class. The gun may be incorporated into one of a LINAC, an induction linear accelerator, a circular accelerator, a DC accelerator, a free electron laser (FEL), a relativistic heavy ion collider (RHIC), and a high-energy x-ray source.

In addition, the encapsulated design of the cathode device 70 advantageously allows for ease of field installation, removal, and replacement, making the currently used "load-lock" systems in high-energy accelerators, for example, unnecessary.

A housing 92 supporting the window 86 and encapsulating the device 70 under vacuum may include any material which is capable of maintaining an ultra-high vacuum within an accelerator environment.

Referring to FIG. 3 and FIGS. 4*a*-4*c*, another method for generating a high-current high-brightness beam in accordance with the present invention includes inserting a secondary emission cathode device 70 into an RF accelerating cavity 14, and providing an electric field to accelerate the primary electrons to the emitter and the secondary electrons through the emitter and accelerate the emitted secondary electrons from the secondary emission cathode device 70.

In a preferred method, the cathode device 70 includes a high QE photocathode 72, which generates primary electrons in response to a low power laser beam incident thereon.

In operation, in the electron gun system 80 shown in FIG. 3, the primary electrons generated by the cathode 72 are accelerated to a few thousand electron-volts then strike the specially prepared window 86. Secondary electrons are produced in the emitter 12. The large Secondary Electron Yield (SEY) provides a multiplication of the number of electrons, i.e., secondary electrons, preferably by about two orders of magnitude. The secondary electrons drift through the window 86 under an electric field and emerge into an RF cavity 14 and preferably into the accelerator proper 62 of the gun 80 through a negative-electron-affinity surface 90 of the window 86 (see FIG. 4*c*). Preferably, the accelerating field is provided by the electrical field of the accelerator proper 62, where the accelerating field penetrates the window 86.

The use of the secondary emission enhanced photocathode device 70 in an electron gun advantageously reduces the number of primary electrons required due to the large SEY. The requirement for high laser power is, therefore, eliminated. Instead, a very low laser power can be used to produce the primary electrons in a photocathode. For example, due to the large SEY of the emitter 12, the primary photoemission current generated by the laser in FIG. 3 may be as low as 10 or 20 mA, i.e., a low operating current laser may be used.

In the case of cascading emitters 12 or plates 102 (see FIG. 5*a*), the primary photoemission current can be advantageously reduced even further, to below about 100 microamperes. In addition, low thermal emittance is achieved due to the NEA surface of the specially prepared diamond emitter 12, with the diamond also having the advantage of rapid thermalization of the electrons.

The operation of the enhanced photocathode 70 is described in detail for the most preferred embodiment of the superconducting RF electron gun 60 operated in CW mode. The enhanced photocathode 70 of the present invention may also be used, however, in normal conducting pulsed RF guns and DC guns.

Referring again to FIGS. 4*a*-4*c*, a photocathode of the present invention may include any photoemissive material, including metals, multialkali, alkali telluride, alkali antimonide, and multialkali antimonide cesiated semiconductors. One skilled in the art knows to choose an optimum photoemissive material, e.g. based on its QE at a particular wavelength and compatible lasers.

In one preferred embodiment, the photocathode 72 includes cesium potassium antimonide, $CsK_2Sb$. The primary beam is preferably generated by a laser, operating at a wavelength of about 0.5 micron or about 0.3 microns, striking the cesium potassium antimonide photocathode 72.

The cathode device 70 is preferably mounted on a cathode stalk 74, which is thermally insulated from the gun cavity 14. When the device 70 is used in a superconducting gun cavity, the stalk 74 is preferably cooled to liquid nitrogen temperature. A choke joint (not shown) preferably provides electric continuity to the gun cavity 14 and prevents leakage of RF field through the cathode stalk 74.

The operation of an enhanced secondary emission cathode device 70 of the present invention for the preferred superconducting RF gun 60, with a photocathode as the cathode 72, is as follows. Primary electrons in the RF electron gun 60 are generated by laser light illuminating a high-quantum efficiency photocathode 72, such as $CsK_2Sb$ (cesium potassium antimonide). The cathode 72 is situated behind the thin (about 10 to 20 micron) specially prepared negative-electron-affinity diamond window 86. The electric field of the cavity 14 penetrates the diamond 86 into a small gap or drift region 94 (preferably under about 1 mm) between the photocathode 72 and the diamond window 86, terminating on the photocathode. The primary electrons are accelerated by this field to a few keV and strike the diamond 86.

The electric field of a superconducting gun cavity 14 is quite high, of the order of about 10 to 20 MV/m at the launch phase of the electrons from the photocathode (corresponding to about 30 MV/m peaks field). Thus, a gap of 0.5 mm between the photocathode and the diamond will provide over 5 to 10 keV of primary electrons at the time they strike the diamond. One skilled in the art can choose the gap appropriate for the application.

The electrons are stopped rapidly at the input side of the diamond window 86, generating a cascade of secondary electrons. The number of secondary electrons generated depends on the primary energy, but at least 100 secondary electrons per primary have been measured. The secondary electrons drift through the diamond 86 under the electrical field.

The surface 90 of the diamond 86 on the superconducting cavity or injection side 84 is specially prepared by hydrogen bonding to be an enhanced Negative Electron Affinity (NEA) surface. The electrons are thermalized in passage through the diamond 86 to sub eV temperature. The NEA surface 90 allows them to exit the diamond, therefore, with a very low thermal emittance.

The amount of primary electrons needed is about two orders of magnitude lower than the number of secondary electrons produced, thus a quantum efficiency of about 10% from $CsK_2Sb$ will be translated to a very high quantum efficiency of about 1000% from the device 70 including a photocathode and diamond secondary emitter 12. This makes the laser, a traditionally difficult component of any photoinjector, into a rather trivial device.

In addition, the modular, encapsulated design of the cathode device 70 and device 100 (see FIG. 5*a* and FIG. 5*b*) allows the use of otherwise contaminating, but high QE photocathodes, which include, e.g., cesium. These cathode devices (device 70, FIG. 4*a* and device 100, FIG. 5*a*) can also advantageously be stored in atmosphere, without degradation of either the cathode 72 or the secondary emitter(s).

Referring to FIGS. 4*a*-4*c*, in this preferred embodiment, the primary and secondary electrons are generated on opposite sides of the diamond window 86. The production of the secondary emission electrons (SEE) takes place substantially on the input side on which the primary electrons impinge, which is internal to the evacuated device 70, and the emission takes place on the other side, from the emitting surface 90. The two processes, production and emission, are thus separated.

The separation of these processes allows the properties of the two surfaces and of the bulk of the diamond to be individually tailored to optimize the processes of electron production, transport, and secondary electron emission. For example, the electrical conductivity of the layer 88 at the input surface receiving the primary electrons is preferably optimized to reduce the heat load from the replenishment current. In addition, the thermal conductivity of the diamond bulk is preferably optimized for waste heat removal. The secondary emission surface 90 is preferably optimized for best NEA conditions.

The low emittance possible with the thermalization of the electrons and the NEA surface 90 combines with the high electric fields of the superconducting cavity 14 (typically about 30 MV/m on the photocathode 72) to advantageously produce a low space-charge emittance. In addition, the high thermal conductivity of diamond makes it an ideal candidate for high current applications. The secondary emission enhanced photocathode device 70 in a superconducting gun, therefore, will allow an extremely small emittance at very high current, and is an ideal electron beam generator for various projects such as the electron cooling of the relativistic heavy ion collider (RHIC), an energy recovery LINAC (ERL) light-source, or megawatt class free electron lasers (FELs).

The device 70 may be used in an electron gun for injection into one of a linear accelerator (LINAC), an induction linear accelerator, a circular accelerator, a DC accelerator, a free electron laser (FEL), a relativistic heavy ion collider (RHIC) and a high-energy x-ray source. Many other applications are possible, as well, such as a compact, high-flux Compton-scattering device to produce short-pulse hard X-rays for medical diagnostics and industrial applications and extremely powerful terahertz radiation.

Figure 5B:
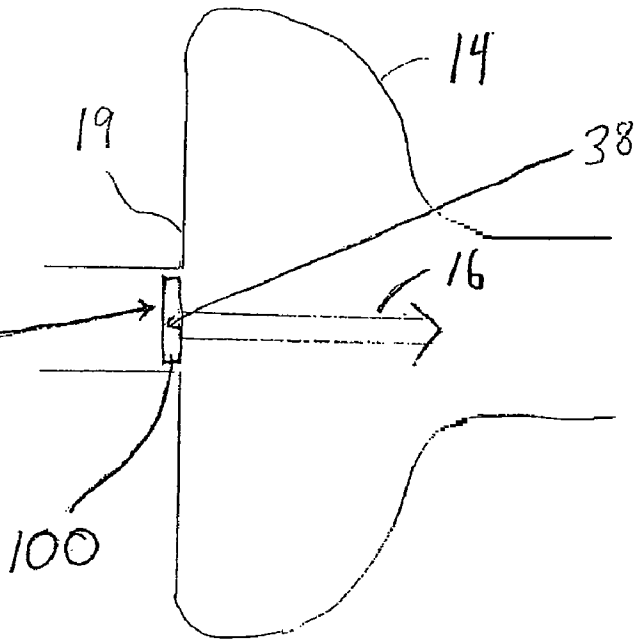
FIG. 5*b* is a side view of the cathode device of FIG. 5*a* inserted into the RF cavity of an electron gun of the present invention.
Figure 5A:
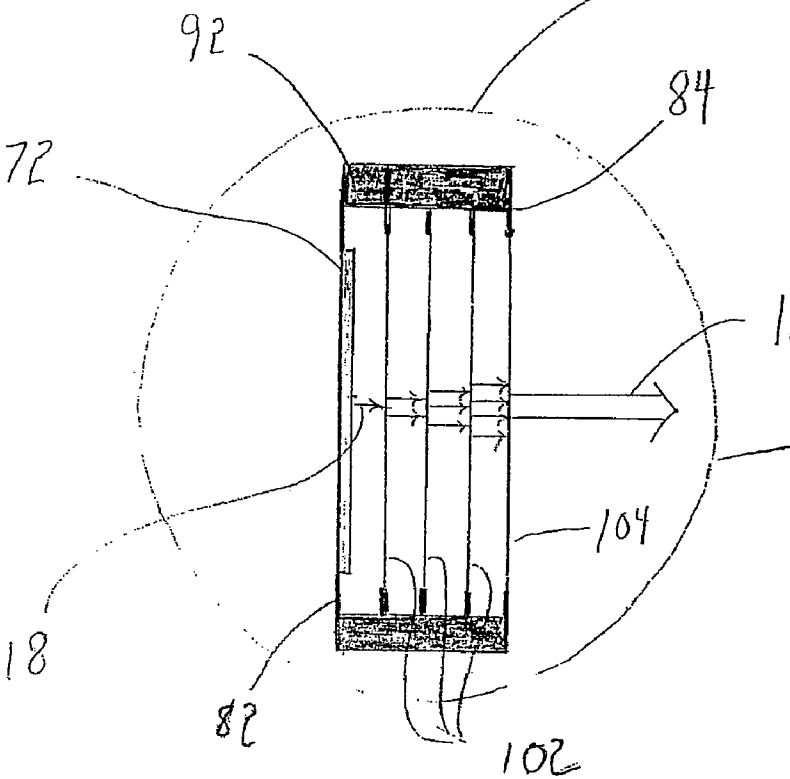
FIG. 5*a* is a side view of another embodiment of a secondary emission enhanced cathode device of the present invention.

In another embodiment shown in FIG. 5*a* and FIG. 5*b*, a secondary emission enhanced cathode device 100 includes a plurality of secondary emission enhancing windows or plates 102 including a last plate 104. The plates 102 and 104 are positioned in cascading fashion, with the output of one used as the input to the next, and so on, increasing dramatically the current gain of the combined device 100. Each enhancing plate 102 preferably includes the window 86 with the electrically conductive layer 88 for current replenishment and an enhanced NEA surface 90 on the emitting side of each plate 102.

The last plate 104 which is adjacent the accelerating region includes a non-contaminating window 86 including one of the non-contaminating secondary emitters 12 of the present invention. Preferably, the last plate 104 includes one of polycrystalline diamond and pure single-crystal diamond, with the enhanced NEA surface 90 including hydrogen bonds. Most preferably, the last plate 104 includes hydrogenated single-crystal diamond. The remaining internal plates 102 may include any of the enhanced NEA materials of the present invention including, for example, boron-doped diamond, with a cesium-enhanced emitting surface.

Preferably, the cathode 72 is a photocathode so that primary electrons 18 are generated in response to a laser beam 38 impinging thereon. Such a cascaded secondary emission enhanced cathode 100 can use a low power laser with a rugged but low quantum efficiency metallic cathode as the initial source of the primary electrons. The entire cascaded cathode 100 is preferably maintained under ultra-high vacuum.

In another preferred embodiment, an electron gun formed in accordance with the present invention includes the cascading cathode 100 of FIG. 5*a* placed in an RF superconducting cavity, positioned as shown in the cavity 14 in FIG. 5*b*.

In alternate embodiments, the secondary emission cascading cathode 100, like the secondary emission enhanced cathode 70 of FIG. 4, can be similarly disposed for use in a DC electron gun as well as in an RF electron gun. The RF electron gun can be either a pulsed or CW device, normal-conducting or superconducting.

The most preferred secondary emitter 12 of the present invention, especially when its surface forms part of the back wall 19 of the cavity 14, includes pure diamond, preferably with an enhanced NEA hydrogenated surface 13. The diamond emitter 12 serves a dual purpose as both a secondary emitter and a protective cover, shielding the cathode 72 from contamination by the gun and the gun (especially a superconducting gun) from contamination by the cathode 72.

In some cases, the diamond secondary emitter 12 may be primarily used to prevent the cathode and the gun cavity from contamination, so that an SEY of the emitter 12 of about 1, or even less, may be acceptable. In one embodiment of a cascaded device 100, therefore, an overall secondary emission yield of the device 100 may be about the same as the SEY of an internal emitter of an internal plate 102. For example, for a hydrogenated boron-doped polycrystalline diamond emitter of the present invention, with a low doping concentration, the SEY is about 50 for an incident electron energy of about 1.5 keV, so that the overall SEY of the device 100 which includes a boron-doped diamond emitter 102 and an emitter plate 104 having an SEY of about 1 is about 50.

In another embodiment of the device 100, the emitters 102 and emitter 104 are chosen so that the overall SEY is increased to equal to or greater than about 1000.

The physical and electronic properties of diamond make it a very attractive candidate for use as a high current density secondary electron emitter, especially for use in an RF superconducting CW injector. For example, diamond has a high electric field electron and hole velocity of greater than about $10^7$ cm/s at about 2 MV/m field, a gradient that is in a range characteristic of many RF injectors. Such a high velocity decreases the transit time of the secondary electrons through the emitter medium.

Diamond can also be doped to a desired boron concentration which yields desired values of electrical resistivity, low trap density and high carrier mobility. Both hydrogenated, boron doped diamond, as well as undoped diamond, have been shown to have negative electron affinity, thus increasing the secondary electron yield to greater than about 80 for a 3 KeV primary electron (see Shih, et al.). For the present invention, in addition to choosing a non-contaminating secondary emitter, the heat load due to the field of the RF cavity 14 must be considered in choosing the last emitter (104 in FIG. 5, 12 in FIG. 2) which forms part of the wall 19 of the accelerator.

The energy distribution of the secondary electrons produced in the diamond emitter of the present invention is preferably less than about 1 eV, centered ~4.5 eV above the Fermi energy. Although this energy distribution is larger than the thermal distribution of the electrons, it is advantageously small enough to provide a high brightness electron beam. With an energy spread below 1 eV, the normalized emittance is expected to be less than about 2 microns. Therefore, both the emittance and temporal spread are advantageously very low.

The energy distribution of the secondary electrons traversing the diamond will be the result of equilibrium. On one hand, the electric field pumps energy into the electrons and the elastic collisions randomize this energy. On the other hand the inelastic collisions remove thermal energy from the electrons, so that the electron temperature will tend towards the lattice temperature. This process has been calculated for the secondary emitters of the present invention, which have been found to have a low electron temperature of about 0.1 eV and a temporal width of ~1 ps when used in typical RF gun systems. A slightly larger energy distribution has also been calculated, but with a corresponding narrower temporal width. In either case, the brightness of the secondary electrons expected from simulations of the secondary emitter of the present invention in typical RF guns was found to be very high.

Transport of low energy electrons through diamond is known to be very efficient. In addition, the thermal conductivity of diamond is known to be in the range of 20 W/cmK at room temperature and even higher at liquid nitrogen temperature. Dissipation of the heat generated by the high-energy electrons as well as the high current, therefore, becomes manageable with such high conductivity.

Diamond is preferred for use as a secondary emitter in the present invention, in part due to its high secondary emission coefficient or high SEY. As is well-known to those skilled in the art, the secondary emission coefficient will depend partly on the energy of the primary electrons.

Diamond films are extremely robust, and thin film diamond emitters can be fabricated which will have a long-life even in an accelerator environment. The use of diamond secondary emitters also provides an independent source of control over the injected secondary beam parameters, i.e. of charge distribution in both time and space. The temporal distribution of the secondary electron beam from the injector may be modified simply by changing the energy of the primary electron beam. In addition, the spatial distribution can also be tailored by appropriate combination of the primary electron energy and the thickness of the diamond emitter. Since optimizing the spatial distribution of the charge minimizes the emittance from the injector, i.e. from the main accelerator, the electron gun of the present invention, which employs a diamond secondary emitter, is advantageously compatible with requirements for a free electron laser (FEL).

Referring to FIG. 4*c*, an optimal thickness 106 of the diamond emitter 12 is preferably calculated according to the electric field which will accelerate the secondary electrons and the properties of the accelerating source. Specifically, parameters of importance in optimizing the thickness 106 include the temperature of the secondary electrons subjected to the accelerating field, the transit time and temporal spread of the secondary electrons through the emitter 12, and the thermal load on the diamond emitter 12, which, for a thicker diamond, is dominated by the energy loss of the secondary electrons in transporting through the thickness of the emitter 12.

For the preferred embodiment of the laser photocathode superconducting RF gun system, assuming primaries are emitted in a range from about 1.5 keV to about 3 keV, the thickness 106 of the diamond emitter 12, where the thickness 106 includes the enhanced NEA layer 90 (see FIG. 4*c*), is less than or equal to about 10 microns.

In another embodiment, the thickness 106 of the diamond emitter 12 is equal to or less than about 100 microns.

Referring to FIG. 6, in another embodiment, a secondary emission electron gun 110 of the present invention can greatly improve the efficiency of a radio frequency source called a lasertron. A lasertron is a device which produces high power radio frequency waves using a laser with a photocathode to produce electrons, in place of the thermionic source used in a typical radio frequency source called a klystron. In a klystron, a continuous electron beam is generated with a thermionic gun and accelerated with a DC electric field. The beam then passes a low power RF cavity which leads after some drift to a bunched beam. A second cavity decelerates the beam, extracting the RF power. The efficiency of such a device increases with shorter bunch length. A lasertron replaces the thermionic gun and buncher cavity with a photocathode. The laser/photocathode combination allows extremely short bunches to be created. While this advantageously increases the efficiency, the produced RF power is limited by the beam current in the photocathode, which, in turn, is limited by the available laser power.

The secondary emission gun 110 of the present invention can increase the beam current of a lasertron by up to two orders of magnitude, using the same available laser power as used in conventional systems. In the embodiment of FIG. 6, the secondary emission gun 110 formed in accordance with the present invention provides a source of electrons to a lasertron 112. The gun 110 includes a laser 114 with photocathode 72 to generate a bunched beam 118.

The gun 110 also includes the secondary emitter 12 of the present invention, which includes a non-contaminating negative-electron-affinity material having an enhanced negative-electron-affinity emitting surface 90, and an electrically conductive layer 88 superposed on the input surface, as shown in FIG. 4*c*. The photocathode 72 and secondary emitter 12 are preferably encapsulated in an secondary emission enhanced cathode device 70 as shown in FIG. 4*a*, but may also be separately mounted in the secondary emission gun 110 of the lasertron 112.

Referring again to FIG. 6, the emitter 12 is directly exposed to an electric gradient created by a DC high voltage power supply 122 to accelerate secondary electrons toward an anode 124 and into an extraction cavity 126 of the lasertron 112. The generated RF source power may be extracted at a power output port 128. Since the DC field does not penetrate the electrically conductive layer, e.g. gold, of the preferably diamond emitter 12, a second high voltage source 130 is preferably included to provide the field gradient between the photocathode 72 and the diamond window 86 (see FIG. 4*a* and FIG. 4*c*) needed to accelerate the primary electrons.

Figure 7:
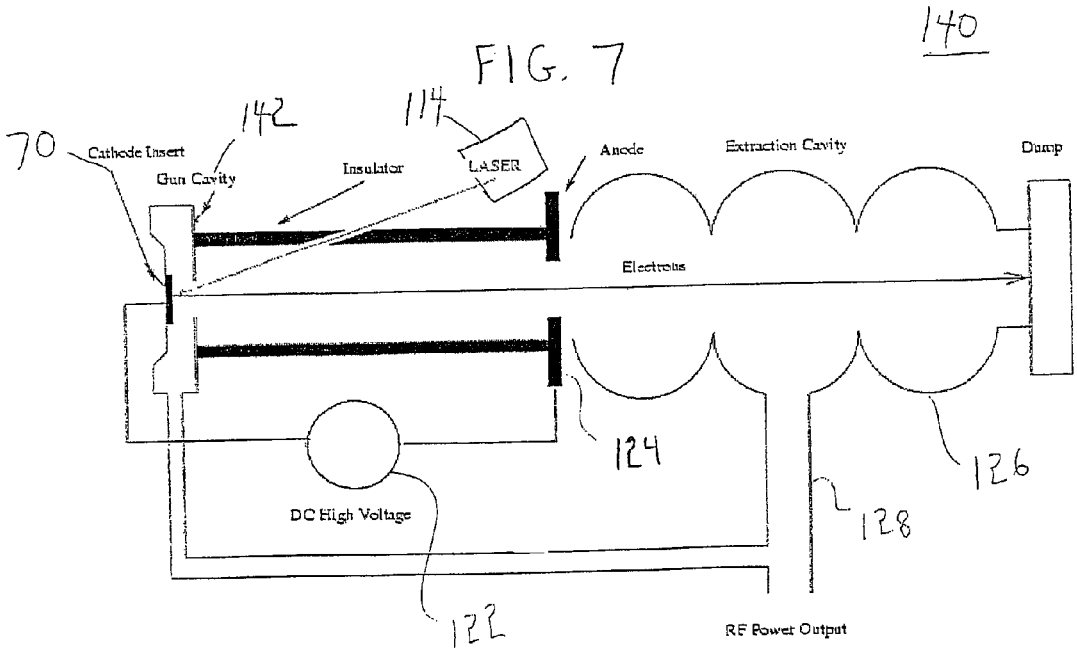
FIG. 7 is a schematic representation of another embodiment of a lasertron including an electron gun formed in accordance with the present invention.

In another embodiment of a lasertron 140 shown in FIG. 7, the enhanced photocathode device 70 of the present invention is placed inside a short gun cavity 142, which is powered by a small fraction of the generated RF power extracted from the output port 128. The power gained by the beam in this cavity 142 is recovered in the extraction cavity 126. This arrangement has the advantage of much higher gradients at the cathode 72 (see FIG. 4*a*) in the device 70, where the beam energy is low and space charge forces ore high. The longitudinal beam dynamics are preferably optimized through the choice of the peak field and phase of the gun cavity 126 in order to optimize the efficiency. The DC power supply 122 accelerates the secondary electrons toward the anode 124. Since the RF field penetrates the electrically conductive layer 88 (see FIG. 4*a*), no additional high voltage source is necessary for the acceleration of the primary electrons

EXAMPLE

Various parameters of the secondary electron beam 16 generated from the diamond emitter 12 of the present invention have been calculated for the most preferred embodiment of a laser photocathode RF gun system 80 shown in FIG. 3, where the RF cavity 14 is part of a CW superconducting RF gun, preferably operating at about 703.75 MHz. These RF parameters coincide with operation of the electron gun for the Relativistic Heavy Ion Collider (RHIC) electron cooler at Brookhaven National Laboratory, Upton, N.Y.

The source of the primary electrons 72 is assumed to be a photocathode illuminated by a laser pulse with only a single stage (pure diamond) secondary emission enhanced photocathode 70, as shown in FIG. 3 and FIG. 4*a* and FIG. 4*b*.

The thermal drift of electrons in gold, which is used to conduct a replenishing current to the diamond, is well known and is actually a very monotonic and slow function of the applied field. The thermal drift velocity at room temperature is known to be about $10^5$ m/s for both pure and boron doped diamond. At fields of the order of a few MV/m, the drift velocity at room temperature is approximately $2\times10^5$ m/s. Data at room temperature were fitted to a straight line result $$V_d=10^5\,(0.2E+0.55) \tag{1}$$

where $V_d$ is the drift velocity in m/s, E is the instantaneous electric field in the diamond in MV/m. This is just an approximation over a limited range around 1 to 2 MV/m, which is sufficient for our present purpose.

In the following, the gold conducting layer and diamond properties are applied to calculate various expected parameters of the secondary electron beam generated by a secondary emission enhanced cathode of the present invention.

Secondary Electron Temperature

The inelastic mean free path (IMFP) of the electrons in the diamond and the acceleration by the electric field determine the equilibrium temperature attained by the drifting electrons. Since the IMFP is energy dependant, the temperature and the inelastic mean free part must be simultaneously solved for.

The equation for the equilibrium electron random energy $E_e$ as a function of the inelastic mean free path $\lambda_i$ and the lattice temperature $T_l$ and the electric field in the diamond can be written as follows:

$$\frac{E_e - kT_l}{\tau_w} = -eEV_d \tag{2}$$

k is the Boltzmann constant, e is the electron's charge and E is the electric field in the diamond. $V_d$ is the drift velocity and $\tau_w$ is the relaxation time of the electron's temperature to the lattice.

Neglecting the lattice temperature, and expressing the relaxation time as a function of the electron's thermal energy and the IMFP, the following is derived:

$$\frac{1}{2}mV_e^3 = -eEV_d\lambda_i \tag{3}$$

For the IMFP, the known semi-empirical formula is provided as follows:

$$\lambda_i = \left[538E_r^{-2} + 0.41(a_m E_r)^{\frac{1}{2}}\right]a_m, \tag{4}$$

where $a_m$ is the thickness of a monolayer in nanometers. For diamond, $a_m$=0.1783 nm. $E_r$ is the electron's energy above the Fermi level. At the low energies near equilibrium, the first term dominates. Expressing the energy above the Fermi level as $$E_r = E_e + \Delta \tag{5}$$

where Δ=EC−EF is the energy of the conduction band above the Fermi energy, numerically equations (3) and (4) can be solved. The following values are used: a band gap of 5.5 eV, and the Fermi energy of 2.725 eV below the conduction band, i.e., Δ=2.775 eV. The solution of the equations for a field E of 2 MV/m results in $E_e$=0.1 eV, a comfortably low temperature. The corresponding IMFP is $\lambda_i$=12.5 nm. The maximum energy that the electron can gain during one IMFP is $eE\lambda_i$, which is 0.024 eV.

Transit Time and Temporal Spread

The transit time of the electrons must be considered in an RF gun application, since this transit time appears as a delay between the arrival time of the primary electrons and the emergence of the secondary electrons into the gun. During this time the phase of the RF field is advancing and the various calculations must take this time dependence into account.

For the known drift velocity of $1.5\times10^5$ m/s, the time of flight thorough a 10 micron thick diamond is 66 ps, or about 17 degrees of phase at 703.75 MHz, a reasonable number. In fact, the mobility of electrons increases with lowered temperature, and that may reduce the flight time by a factor of 2 if the diamond temperature is reduced from 300° K to about 100° K (the mobility at low field increases more dramatically with lowered temperature, but at a few megavolts per meter the increase is smaller).

Another important consideration is the spread in the time of arrival of the secondary electrons at the far side of the diamond window. Most applications of electron guns place an upper limit on the final pulse width. There are two mechanisms that have to be considered.

The temporal spread can come from two sources. One is the random walk due to the thermal energy; the other is the space-charge induced bunch spread. In the random walk part of the problem, the mean free path of the electrons must be considered.

At very low energy most of the momentum modification of electrons takes place through elastic collisions. The elastic cross-section can be estimated by Mott's formula, the total cross-section of electrons under 10 eV is about $\sigma=10^{-15}$ cm$^2$. The number of elastic collisions is about:

$$Nela = \sigma \times \frac{L}{A^3} = 1.76\times10^5 \tag{6.1}$$

where L is the diamond thickness and A=0.178 nm is the atom radius of diamond. If one assumes that after 10 times of elastic collisions the momentum is randomized, then the number of times that the electron may be stopped by elastic collision is about:

$$\text{Nstop(ela)}=1.76\times10^4. \tag{6.2}$$

The number of inelastic collisions is about:

$$\text{Nstop(ine)}=L/\lambda_i\approx800. \tag{6.3}$$

So, the number of times that electrons may be stopped by inelastic collisions can be ignored. The broadening is about:

$$\Delta T\approx T/\sqrt{N_{\text{stop}}(\text{ela})}\approx(L/V_d)/\sqrt{N_{\text{stop}}(\text{ela})}\approx0.7\text{ ps}. \tag{6.4}$$

Thus, the broadening due to thermal random walk of the electrons can be assumed negligible.

The space-charge induces the main temporal spread that must be considered. The part that is different from what takes place in any high-bunch charge electron gun is that the electrons spend a period of time in the diamond, moving at a relatively low velocity. At the same time, the space charge fields are reduced by the dielectric constant of diamond, which is $\epsilon_r$=5.7. The geometry of the diamond window facilitates the calculation, since the electrons are spread over a very thin, wide disk. A precise calculation should take into account the time dependence of the RF accelerating field, but for a rough estimate, the field can be assumed constant (E=2 MV/m in the diamond, e.g, corresponding to $\epsilon_r$E=5.7×2 MV/m external field). For the R=5 mm cathode radius, at a charge of Q=1 nC per bunch, the space charge electric field acting on either end of the bunch on account of the bunch-charge is $$E_{sc} = \frac{Q}{\pi R^2 \varepsilon_0 \varepsilon_r} \tag{7}$$

or about 0.25 MV/m. Thus the head of the bunch will move under a field of 2.25 MV/m and the tail will move under a field of 1.75 MV/m. Now equation (1) can be used to calculate the resulting drift velocities of the head and tail, and the resulting time of flight. It can be found that, for room temperature, the head of the bunch will leave the diamond 10 ps ahead of the tail, in addition to the original bunch spread. At 703.75 MHz, this amounts to about 2.5 degrees. At 100° K, the effect is reduced to a totally negligible sub-degree spread.

Thermal Load on the Diamond

Heat is generated by a number of sources: the energy deposited by the primary electrons; the current flowing through the gold electrode to replenish the escaped charge (it is easy to verify that even for a very thin gold layer of 10 nm thickness this is a negligible source of heat and will not be calculated here); and heat developed by the transit of the secondaries through the diamond.

These heat sources are evaluated and the temperature rise of the diamond is estimated here, assuming it is cooled on the periphery to near liquid nitrogen temperature.

The primary electrons' heat load is indicated herein as, $P_p$. Given that the secondary emission yield is approximately proportional to the primary energy, the heat generated by the primary electrons is nearly independent of their energy and depends only on the secondary electron current. Using the data for hydrogen terminated diamond (J. E. Yater, et al., "Electron Transport and Emission Properties of C(100)," *Phys. Rev. B*, Vol. 56, No. 8, pp. R4410-R4413 (Aug. 15, 1997-II), the secondary emission coefficient δ is 60 at $E_p$=3 keV primary energy. Let the primary current be $I_p$ and the secondary current $I_s$, then $$I_p = \frac{I_s}{\delta} = \frac{50 I_s}{E_p}, \text{ and} \tag{8}$$

therefore, $$P_p = I_p E_p = 50 I_s. \tag{9}$$

For example, at a secondary current of 0.5 amperes, the primary electron heat load is 25 watts.

The heat load developed by the secondary electron current flowing through the diamond can be calculated very simply by $$P_s = \int_{t_1}^{t_f} I_s \frac{E(t)}{\varepsilon_r} V_d(t) dt \tag{10}$$

where E(t) is the gun electric field at time t, $\epsilon_r$=5.7 is the dielectric constant of diamond and $V_d$ is the drift velocity of the electrons, which acquires a time dependence through its dependence on the field strength. If a peak electric field in the gun (on the cathode) is 30 MV/m, a secondary phase of emission from the diamond is 30 degrees, a 10 microns thick diamond is used, the drift velocity is as described above, and a secondary current of 0.5 amperes is assumed, the secondary electron heat load (calculated by integrating over the time dependence of the field) is about 17 watts.

The temperature rise can be calculated given some dependence of the thermal conductivity on temperature. The thermal conductivity coefficient k (in units of W/m° K.) can be approximated in the temperature range of 100° K to 300° K as $$k(T) \sim 14000 - 40T \tag{11}$$

This is a very crude approximation, meant just for the purpose of a rough estimate of the temperature increase in the diamond. Assuming that the edge of the diamond is at $T_e$=100° K, and that the temperature rise is not bigger than 100° K, then we can integrate the temperature change across the diamond and get approximately $$14000(1 - 60T_e)\Delta T \sim \frac{P}{4\pi t} \tag{12}$$

or $$\Delta T = \frac{P}{3.2 \times 10^4 \pi t} \sim 42 \tag{13}$$

where P is the total power deposited, which for our example is 42 watts, and t=$10^{-5}$ meter is the thickness of the diamond. The result justifies the approximation made above. It shows that the excellent thermal conductivity of the diamond results in a negligible temperature rise in the diamond window.

Increasing the thickness of the diamond improves the cooling and does not change $P_p$. The cooling and $P_s$ are proportional to the diamond thickness. Thus, as long as $P_p$ does not become negligible, the temperature rise at the center of the window will decrease with increasing thickness, tending to about 11° K.

The conductivity used above may be a bit on the optimistic side for a typical diamond sample. Indeed some samples are measured at room temperature to have a thermal conductivity half of the value used above. To estimate the worst possible case, thermal conductivity value for the whole diamond was taken as 1000 W/m° K. This results in a temperature rise (center to edge) of 290 degrees, which is still quite comfortable.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

The invention claimed is:

1. A method for generating an electron beam comprising the steps of:

providing a primary beam comprising primary accelerated electrons, the primary beam being substantially directed at a secondary emitter;

emitting secondary electrons from the secondary emitter in response to contact with the primary accelerated electrons; and generating the electron beam by accelerating the secondary electrons in an accelerating region, a cathode providing the primary beam being disposed external to the accelerating region.

2. The method of claim 1, the step of generating comprising the step of accelerating the secondary electrons in the accelerating region in a direction opposite to the primary beam.

3. The method according to claim 1, the secondary emitter comprising one of single crystal and polycrystalline diamond, and the emitting surface comprising terminated hydrogen bonds.

4. A method for generating a high-brightness high-current electron beam comprising the steps of:

inserting an encapsulated secondary emission enhanced cathode device into a radio frequency accelerating cavity, the encapsulated secondary emission cathode device comprising a high quantum efficiency cathode and a non-contaminating secondary emitter;

adapting the high quantum efficiency cathode to emit primary electrons, the non- contaminating secondary emitter emitting secondary electrons in response to the primary electrons; and providing an electric field to accelerate the primary electrons to the input surface of the secondary emitter and to accelerate the secondary electrons through the secondary emitter, the secondary electrons emitted from the encapsulated secondary emission enhanced cathode device being further accelerated by the electric field to generate the high-brightness high-current electron beam.

5. A lasertron for providing radio frequency power comprising:

a photocathode, the photocathode emitting primary electrons in response to a laser beam;

a secondary emitter, the secondary emitter comprising:

a non-contaminating negative-electron-affinity material;

an input surface, the input surface receiving the primary electrons, the input surface comprising a substantially uniform electrically conductive layer, the substantially uniform electrically conductive layer providing a replenishing current to the secondary emitter, the electrically conductive layer being substantially transparent to the primary electrons; and an emitting surface, the emitting surface comprising a non-contaminating enhanced negative-electron-affinity surface;

an anode, the secondary electrons being accelerated from the secondary emitter to the anode by a direct current electric field applied between the secondary emitter and the anode; and an extraction cavity, the extraction cavity receiving the secondary electrons and providing radio frequency power output.

6. The lasertron of claim 5, further comprising a gun cavity, the gun cavity being powered by a fraction of the radio frequency power output, the primary electrons being accelerated to the secondary emitter by a radio frequency field of the gun cavity.

7. The lasertron of claim 5, wherein the non-contaminating negative-electron-affinity material is hydrogenated single crystal diamond, the emitting surface comprising hydrogen bonds.

* * * * *

UNITED STATES PATENT AND TRADEMARK OFFICE

CERTIFICATE OF CORRECTION

PATENT NO. : 7,601,042 B2
APPLICATION NO. : 11/734400
DATED : October 13, 2009
INVENTOR(S) : Triveni Srinivasan-Rao et al.

It is certified that error appears in the above-identified patent and that said Letters Patent is hereby corrected as shown below:

On the title page item (75),
Change the inventorship from -

Triveni Srinivasan-Rao, Shoreham, NY (US)
Ilan Ben-Bvi, Setauket, NY (US)

to -

Triveni Srinivasan-Rao, Shoreham, NY (US)
Ilan Ben-Bvi, Setauket, NY (US)
Jorg Kewisch, Wading River, NY (US)
Xiangyun Chang, Middle Island, NY (US)

Signed and Sealed this
Eighth Day of March, 2011

David J. Kappos

David J. Kappos
*Director of the United States Patent and Trademark Office*